US005236346A

United States Patent [19]

Stonecliffe

[11] Patent Number: 5,236,346

[45] Date of Patent: Aug. 17, 1993

[54] HORIZONTAL CONTINUOUS CASTING APPARATUS

[75] Inventor: David Stonecliffe, Sheffield, England

[73] Assignee: Davy McKee (Sheffield) Limited, United Kingdom

[21] Appl. No.: 768,315

[22] PCT Filed: Mar. 27, 1990

[86] PCT No.: PCT/GB90/00456

§ 371 Date: Feb. 19, 1992

§ 102(e) Date: Feb. 19, 1992

[87] PCT Pub. No.: WO90/11851

PCT Pub. Date: Oct. 18, 1990

[30] Foreign Application Priority Data

Apr. 6, 1989 [GB] United Kingdom ..... 8907762.2

[51] Int. Cl.[5] ..... B22D 11/14

[52] U.S. Cl. ..... 266/236; 266/275; 164/440

[58] Field of Search ..... 266/275, 236; 222/600; 164/440, 437

[56] References Cited

U.S. PATENT DOCUMENTS 3,344,845 10/1967 Blessinger et al. ..... 164/440

FOREIGN PATENT DOCUMENTS 0045549 3/1980 Japan ..... 164/440

*Primary Examiner*—Scott Kastler

*Attorney, Agent, or Firm*—Lee, Mann, Smith, McWilliams, Sweeney & Ohlson

[57] ABSTRACT

A tundish for molten metal having a front wall with an opening is provided. A plate with an opening is fitted into the opening in the front wall and retained therein. By replacing the plate with a plate with a plate having an opening at a different vertical level, the tundish can feed horizontal continuous casting molds of different levels.

4 Claims, 2 Drawing Sheets

HORIZONTAL CONTINUOUS CASTING APPARATUS

This invention relates to a tundish in which molten metal is stored prior to being fed to the mould passage of a horizontal continuous casting mould. The molten metal is fed to the passage by way of a nozzle in a side wall of the tundish and a closed feed tube connecting the nozzle to the mould passage.

Downstream of the outlet of the mould passage there is a structure for supporting the casting horizontally as it is withdrawn from the mould and whilst it is cooled. This structure is often in the form of a roller table. Clearly, the casting leaving the mould has to have its lower surface aligned with the upper surface of the roller table and, consequently, the position of the longitudinal axis of the mould passage relative to the upper support surface of the roller table depends upon the cross-sectional dimensions of the casting.

If the casting apparatus is to be capable of casting workpieces of different cross-section, then different moulds have to be employed and the moulds have to be raised and lowered with respect to the roller table. It is desirable for the longitudinal axis of the mould passage to be aligned with that of the feed tube and that of the nozzle in the wall of the tundish. Consequently, if the longitudinal axis of the mould passage is raised or lowered, it is usual to attempt to raise or lower the tundish. This can lead to difficulties, bearing in mind that the tundish supports a mass of molten metal.

It is also known for two or more moulds arranged side-by-side to be fed simultaneously from a tundish having two or more nozzles connected to the moulds by separate feed tubes. If the moulds produce castings of different cross-section, then the tundish has to be tipped sideways so that the longitudinal axes of the two mould passages remain at the same height above the run-out table. Tipping of the tundish is most inconvenient and can be dangerous.

An object of the present invention is to provide a tundish which enables moulds of different cross-sections to be employed.

According to the present invention, a tundish for molten metal has a substantially vertical front wall with an opening therethrough; at least two metal plates each having the same outer dimensions which are such as to allow the plates to be fitted one at a time in the opening in the front wall to close off the opening and means for retaining the plate in the opening, each of the plates having an aperture of the same cross-section therethrough but the position of the opening in each plate being different from that in the or each other plate whereby the longitudinal axis of the aperture in each plate, when fitted in the opening in the front wall of the tundish, is at a different vertical height.

The plate is used to secure a refractory nozzle in the side wall of the tundish with the longitudinal axis of the nozzle coincident with the longitudinal axis of the opening in the plate. Consequently, by selecting the appropriate plate, the longitudinal axis of the nozzle is aligned with the longitudinal axis of the mould passage and the two can be connected together by way of a feed tube.

If the tundish has a pair of openings in the front wall, different plates can be selected for each opening so that the longitudinal axis of the opening in one plate, while aligned with the longitudinal axis of the mould which it is feeding, is at a different vertical height from the longitudinal axis of the opening in the other plate and the mould which is being fed through the nozzle and feed tube associated with that plate. Thus, tipping or raising of the tundish is not required.

BRIEF DESCRIPTION OF THE DRAWINGS

In order that the invention may be more readily understood, it will now be described, by way of example only, with reference to the accompanying drawings, in which.

Figure 1:
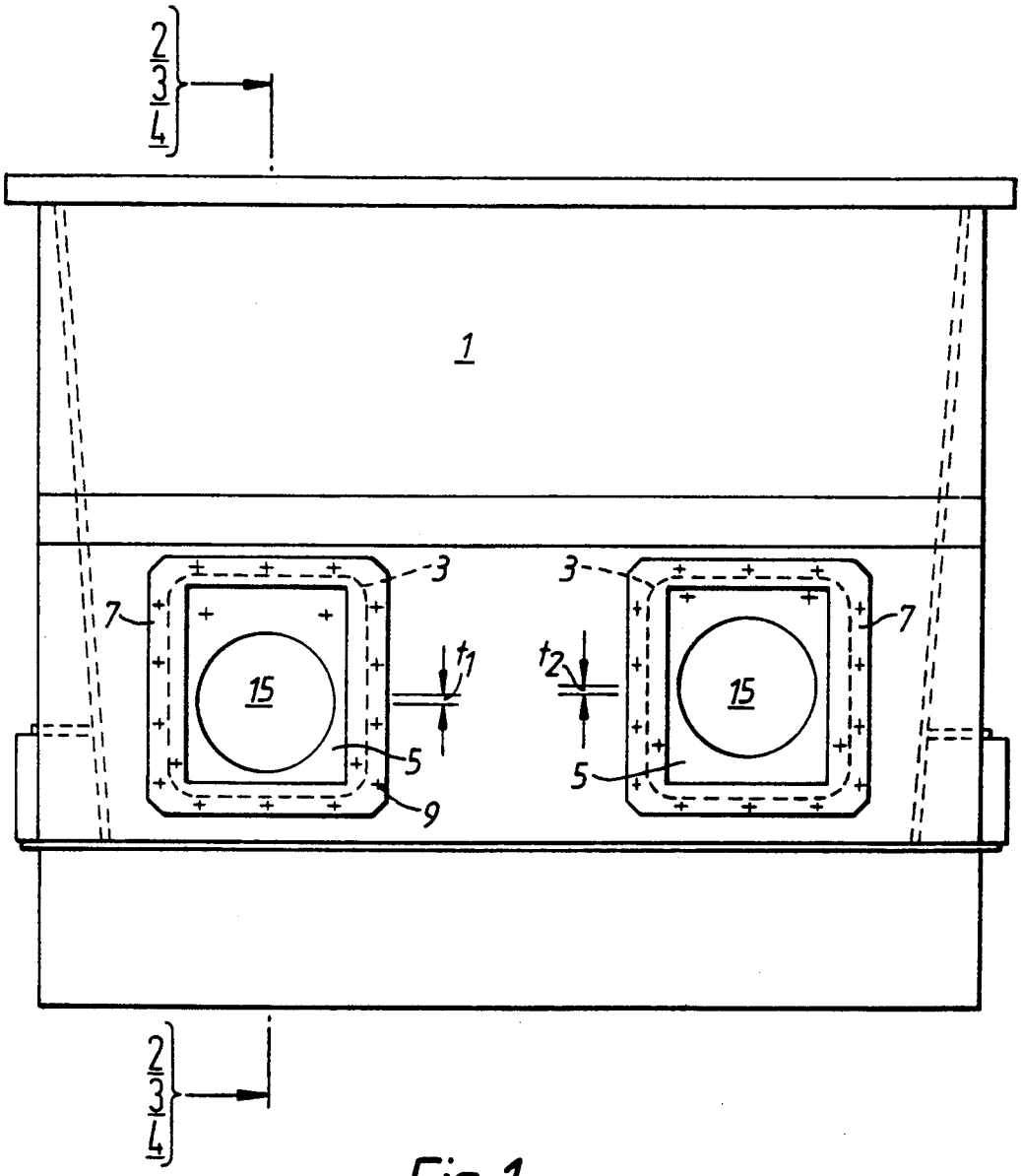
FIG. 1 is a front elevation of a tundish.

A tundish for molten metal has a substantially vertical front wall 1 having a pair of identical openings 3 formed side-by-side therethrough. A metal plate 5 has outside dimensions which permit it to be fitted into the opening 3 to close off the opening. An edge flange 7 on the plate 5 overlaps the joint between the plate 5 and the front wall 1 and has bolts 9 associated therewith by which the plate 5 can readily be retained in the opening 3. The plate 5 retains a bolster 11 in the tundish and the bolster, in turn, provides a cavity for a nozzle 13.

The plate 5 has an aperture 15 therethrough and the nozzle 13 projects into the aperture 15 with the longitudinal axis of the nozzle coincident with the axis of the aperture. A feed tube 17 abuts against the nozzle 13 and the feed tube, in turn, abuts against the inlet end of the horizontal casting mould 19, as shown by broken lines in FIG. 4.

The tundish is lined with refractory material which is moulded to the inner end of the bolster 11 and the nozzle 13 to provide a passage 20 from the interior of the tundish through the nozzle and feed tube into the inlet end of the mould.

In order to accommodate moulds of different cross-sections it is necessary for the longitudinal axis of the nozzle and feed tube to be adjustable vertically.

Figure 4:
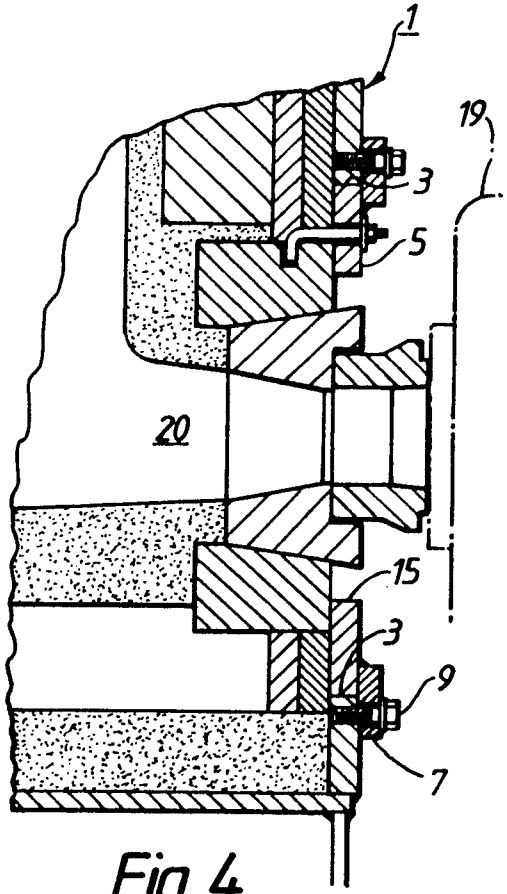
FIGS. 2, 3 and 4 are alternative sectional side elevations on the line A—A of FIG. 1.
Figure 3:
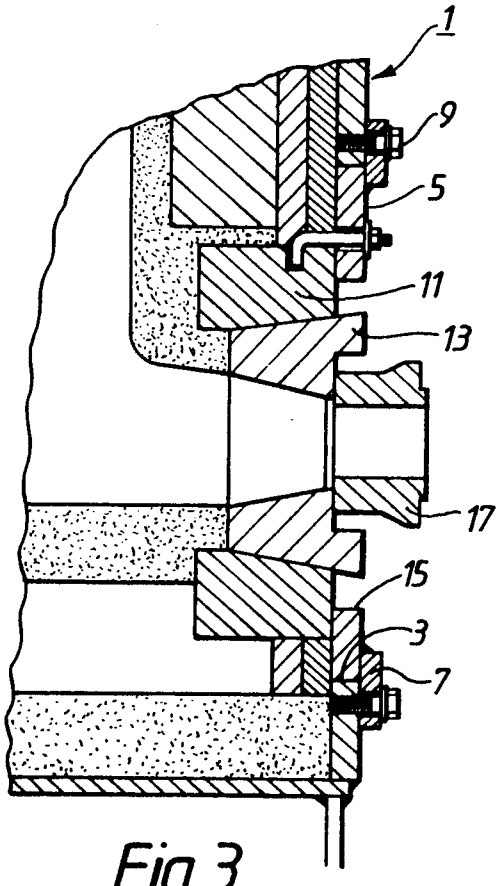
Figure 2:
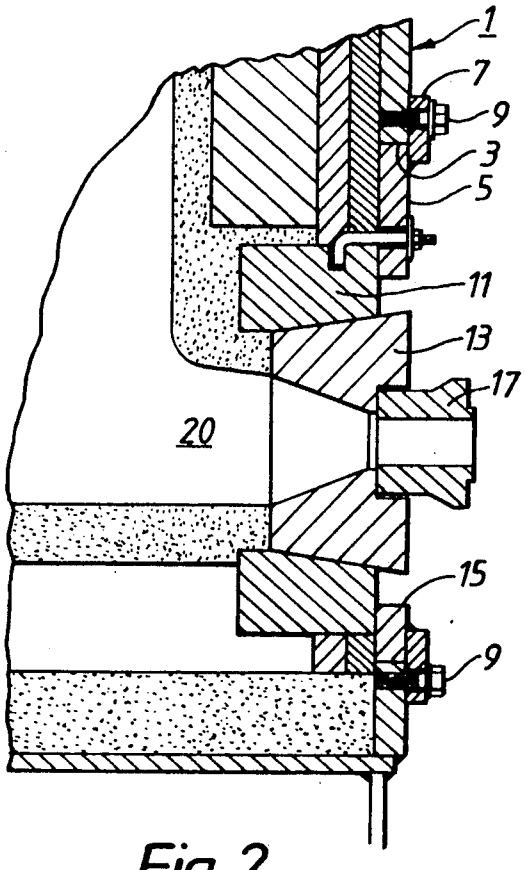

A number of plates 5 are provided, each has the same outside dimensions and each plate has an aperture 15 of the same cross-section therethrough. However, the position of the longitudinal axis of the aperture 15 in the vertical direction is different for each plate. By selecting an appropriate plate 5 to fit in the opening 3, the longitudinal axis of the aperture 15 in the plate has alternative vertical positions, as shown in FIGS. 2, 3 and 4, thus, the longitudinal axis of the feed tube and the nozzle can be kept in alignment with the longitudinal axis of the mould, even when the longitudinal axis of the mould is raised vertically.

As shown in FIG. 1, the front wall of the tundish has two openings in it whereby two castings can be cast simultaneously. The two castings may have the same cross-sectional dimensions, in which case identical plates 5 are used, but, if the castings are of different cross-sectional dimensions then, by choosing two appropriate plates 5, the longitudinal axes of the apertures 15 in the chosen plates can be at different vertical heights with respect to the base of the tundish. For example, the longitudinal axis of the aperture 15 on the left-hand side plate of FIG. 1 is "$t_1$" below the centre of the plate 5 whereas, on the right-hand side, the longitudinal axis of the aperture 15 is "$t_2$" above the centre of the plate 5.

What is claimed is:

1. A tundish for molten metal comprising a base, a substantially vertical front wall upstanding from the base, said front wall defining an opening therethrough with the lowest level of the opening being offset vertically from the base;

at least two metal plates each having the same outer dimensions which permit the plates to be fitted one at a time in the opening in the front wall to close off the opening;

means for retaining the plates in the opening;

each of the plates having an aperture therethrough at a predetermined position and of the same cross section, and each aperture having a longitudinal axis, the positions of the apertures in the plates being different so that, when each plate is fitted in the opening in the front wall, the longitudinal axis of the aperture in the plate is at a different vertical height from the base of the tundish.

2. A tundish as claimed in claim 1, in which each metal plate has means associated with it for retaining a refractory nozzle in the side wall of the tundish with the longitudinal axis of the nozzle coincident with the longitudinal axis of the aperture in the plate.

3. A tundish as claimed in claim 1, in which each metal plate has a surrounding edge flange, a part of which overlies the edge of the plate, and means being associated with said part of the flange to retain the plate in the opening.

4. A tundish for molten metal comprising a base, a substantially vertical front wall upstanding from the base, said front wall defining two openings therethrough with the lowest level of each opening being offset vertically by the same amount from the base;

two metal plates fitted in the openings in the front wall to close off the openings;

means for retaining the plates in the openings;

each of the plates having an aperture therethrough at a predetermined position and of the same cross section, and each aperture having a longitudinal axis, the positions of the apertures in the two plates being different so that the longitudinal axes of the apertures are at different vertical heights from the base of the tundish.

* * * * *